US012427385B2

(12) United States Patent
Whitney et al.

(10) Patent No.: US 12,427,385 B2
(45) Date of Patent: Sep. 30, 2025

(54) GRAPHENE ENHANCED LACROSSE SHAFT

(71) Applicant: EAST COAST DYES, INC., Towson, MD (US)

(72) Inventors: Hamilton Sean Michael Whitney, Baltimore, MD (US); Gregory Lee Kenneally, Lutherville, MD (US); Chia-Jen Hsu, Dayton, OH (US); Bor Z. Jang, Dayton, OH (US); Aruna Zhamu, Dayton, OH (US)

(73) Assignee: EAST COAST DYES, INC., Towson, MD (US)

( * ) Notice: Subject to any disclaimer, the term of this patent is extended or adjusted under 35 U.S.C. 154(b) by 118 days.

(21) Appl. No.: 18/533,924

(22) Filed: Dec. 8, 2023

(65) Prior Publication Data

US 2024/0108954 A1 Apr. 4, 2024

Related U.S. Application Data

(63) Continuation of application No. 17/367,935, filed on Jul. 6, 2021, now Pat. No. 11,865,421, which is a continuation of application No. 16/701,442, filed on Dec. 3, 2019, now Pat. No. 11,090,538.

(60) Provisional application No. 62/779,878, filed on Dec. 14, 2018.

(51) Int. Cl.

| | |
|---|---|
| ***A63B 59/20*** | (2015.01) |
| ***A63B 60/42*** | (2015.01) |
| ***A63B 102/14*** | (2015.01) |

(52) U.S. Cl.

CPC ..... *A63B 59/20* (2015.10); *A63B 60/42* (2015.10); *A63B 2102/14* (2015.10); *A63B 2209/00* (2013.01)

(58) Field of Classification Search

CPC ..... A63B 59/20; A63B 60/42; A63B 2102/14; A63B 2209/00

See application file for complete search history.

(56) References Cited

U.S. PATENT DOCUMENTS

| | | | | |
|---|---|---|---|---|
| 8,342,989 | B2 | 1/2013 | Lammer | |
| 9,050,505 | B2 | 6/2015 | Bond et al. | |
| 11,090,538 | B2 | 8/2021 | Whitney et al. | |
| 2010/0125013 | A1* | 5/2010 | Lammer | A63B 60/00 156/62.2 |
| 2016/0088884 | A1* | 3/2016 | Guerra | A63B 71/1225 2/455 |
| 2017/0158513 | A1 | 6/2017 | Zhamu et al. | |
| 2017/0175309 | A1* | 6/2017 | Van Loon, III | A63B 59/20 |
| 2020/0147462 | A1* | 5/2020 | St-Laurent | B32B 27/08 |
| 2020/0391085 | A1* | 12/2020 | Shassian | A63B 60/50 |

OTHER PUBLICATIONS

Jin et al., "Preparation and characterization of high performance of graphene/nylon nanocomposites," European Polymer Journal 49: 2617-2626 (2013).

* cited by examiner

*Primary Examiner* — Jeffrey S Vanderveen

(74) *Attorney, Agent, or Firm* — MEDLER FERRO WOODHOUSE & MILLS PLLC

(57) ABSTRACT

Lacrosse shafts are provided that include graphene. The graphene increases the durability of the lacrosse shafts. Also provided is equipment for other contact sports that include graphene to increase durability.

6 Claims, 7 Drawing Sheets

GRAPHENE ENHANCED LACROSSE SHAFT

CROSS-REFERENCE TO RELATED APPLICATIONS

The present application is a continuation of U.S. application Ser. No. 17/367,935, filed Jul. 6, 2021, which is a continuation of U.S. application Ser. No. 16/701,442, filed on Dec. 3, 2019, which claims benefit of U.S. Provisional Patent Application No. 62/779,878, filed Dec. 14, 2018, the disclosures of each of which are incorporated by reference herein in their entireties.

FIELD OF THE INVENTION

The invention relates in general to lacrosse shafts, and more particularly to the inclusion of graphene in lacrosse shafts to increase durability.

BACKGROUND OF THE INVENTION

Double-walled, synthetic lacrosse heads have revolutionized the game of lacrosse. The synthetic heads impart a lightness, maneuverability, and flexibility. These performance advantages greatly enhance players' skills and have increased the speed of the game.

Because competitive lacrosse is now essentially a year-round activity, lacrosse equipment is subjected to a wide range of temperature and humidity. Playing temperatures can range from at least 32° F./0° C. to 104° F./40° C., and humidity from single digits to near 100%. On field conditions are often times higher than ambient temperatures in Summer time, upwards of 120° F. Thus, there is a need for a competition lacrosse head that will satisfy playing performance needs in extreme as well as moderate climatic conditions. In addition, there is a need for increased durability in a lacrosse head, while still maintaining a desired flexibility, and in varying temperatures, desired playability.

BRIEF SUMMARY OF THE INVENTION

The present invention fulfills these needs by providing lacrosse heads that comprise various polymers and amounts of graphene to increase durability.

Embodiments hereof are directed to a lacrosse head comprising opposing sidewalls joined at one end by a throat, the sidewalls diverging generally outwardly, and the sidewalls being connected at another end by a scoop. The lacrosse head suitably comprises a blend of a nylon polymer and about 0.1% to about 1% graphene. In embodiments, the lacrosse head has a tensile strength of the throat that is at least about 3% greater than a lacrosse head comprising the nylon polymer without the graphene.

In exemplary embodiments, the nylon polymer is nylon 6-6. Suitably, the graphene is present at about 0.1% to about 0.3%. In embodiments, the tensile strength of the throat is about 5%-7% greater than a lacrosse head comprising the nylon polymer without graphene.

In further embodiments, provided herein is a lacrosse head comprising opposing sidewalls joined at one end by a throat, the sidewalls diverging generally outwardly, and the sidewalls being connected at another end by a scoop. The lacrosse head suitably comprises a blend of a nylon polymer and about 0.1% to about 1% graphene, and the lacrosse head can withstand more than 300 impacts prior to failure, wherein the lacrosse head has attained a kinetic energy of about 25 Joules to about 55 Joules, prior to each impact.

Suitably, the nylon polymer is nylon 6-6, and in embodiments, the graphene is present at about 0.1% to about 0.3%.

Suitably, the lacrosse head can withstand more than 500 impacts (or more than 700 impacts, or more than 1000 impacts) prior to failure, wherein the lacrosse head has attained a kinetic energy of about 25 Joules to about 55 Joules, prior to each impact.

Also provided herein is a lacrosse head comprising opposing sidewalls joined at one end by a throat, the sidewalls diverging generally outwardly, and the sidewalls being connected at another end by a scoop, wherein the lacrosse head comprises a blend of an amorphous nylon polymer and about 0.1% to about 5% graphene. Suitably, the lacrosse head maintains a compression stiffness within about 30% over a temperature range of −15° C. to 52° C., and the lacrosse head can withstand more than 100 impacts prior to failure, wherein the lacrosse head has attained a kinetic energy of about 25 Joules to about 55 Joules, prior to each impact.

In such embodiments, the graphene is present at about 0.1% to about 0.4%. Suitably, the lacrosse head can withstand more than 200 impacts prior to failure, wherein the lacrosse head has attained a kinetic energy of about 25 Joules to about 55 Joules, prior to each impact, and in embodiments, the lacrosse head maintains a compression stiffness within about 15% over a temperature range of 0° C. to 40° C.

In further embodiments, provided herein is a lacrosse head comprising opposing sidewalls joined at one end by a throat, the sidewalls diverging generally outwardly, and the sidewalls being connected at another end by a scoop, where the lacrosse head comprises a blend of a nylon polymer and about 0.1% to about 1% graphene, and the lacrosse head can withstand more than 300 impacts of an impact test prior to failure. The impact test suitably comprises attaching the lacrosse head to a shaft with a length of about 30 inches, the shaft configured to rotate in a circular path, rotating the lacrosse head at a rate of about 20-25 m/s, impacting a spring-loaded, steel impact arm having a weight of about 2-4 lbs., wherein the lacrosse head attains a kinetic energy of about 25 Joules to about 55 Joules, prior to the impact, and repeating the impacting at cycles of 10 impacts/cycle, until the lacrosse head fails.

Suitably, the nylon polymer is nylon 6-6, and in embodiments, the graphene is present at about 0.1% to about 0.3%.

Suitably, the lacrosse head can withstand more than 500 impacts (or more than 700 impacts, or more than 1000 impacts) prior to failure, wherein the lacrosse head has attained a kinetic energy of about 25 Joules to about 55 Joules, prior to each impact.

In still further embodiments, provided herein is a lacrosse head comprising opposing sidewalls joined at one end by a throat, the sidewalls diverging generally outwardly, and the sidewalls being connected at another end by a scoop, wherein the lacrosse head comprises a blend of a polyketone polymer and about 0.1% to about 1% graphene, and wherein the lacrosse head can withstand more than 100 impacts prior to failure, wherein the lacrosse head has attained a kinetic energy of about 25 Joules to about 55 Joules, prior to each impact.

Suitably, in such embodiments, the graphene is present at about 0.1% to about 0.3%.

In further embodiments, the lacrosse head can withstand more than 300 impacts (or more than 500 impacts) prior to failure, wherein the lacrosse head has attained a kinetic energy of about 25 Joules to about 55 Joules, prior to each impact.

BRIEF DESCRIPTION OF DRAWINGS

The foregoing and other features and advantages of the invention will be apparent from the following description of embodiments hereof as illustrated in the accompanying drawings. The accompanying drawings, which are incorporated herein and form a part of the specification, further serve to explain the principles of the invention and to enable a person skilled in the pertinent art to make and use the invention. The drawings are not to scale.

DETAILED DESCRIPTION OF THE INVENTION

Specific embodiments of the present invention are now described with reference to the figures, wherein like reference numbers indicate identical or functionally similar elements. The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
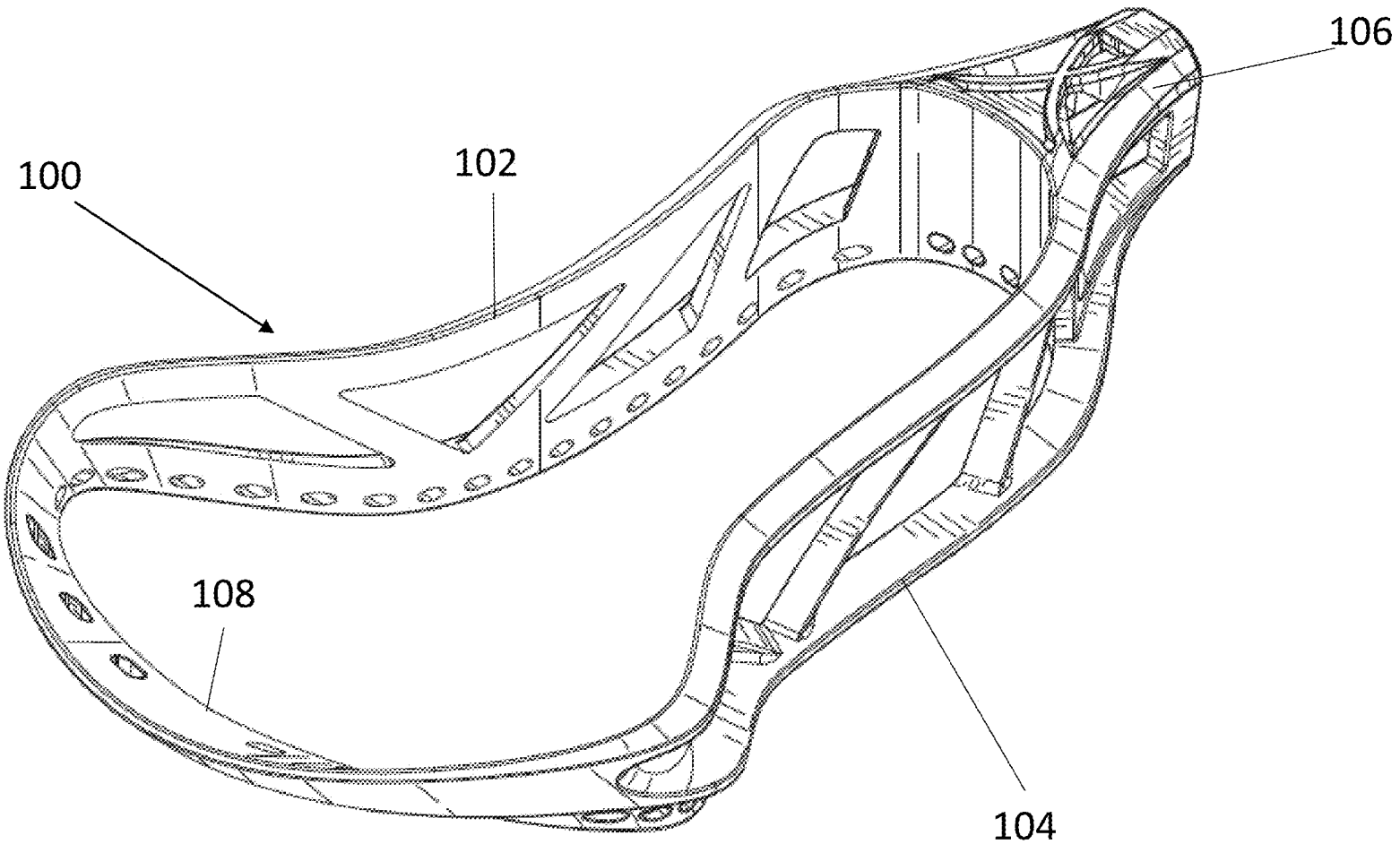
FIG. 1 is a perspective view of a lacrosse head according to embodiments hereof.

Embodiments hereof relate to a lacrosse head. FIG. 1 shows an exemplary lacrosse head 100, that includes opposing sidewalls (102 and 104) joined at one end by a throat 106, the sidewalls diverging generally outwardly, and the sidewalls being connected at another end by a scoop 108. The diagram of lacrosse head 100 is not meant to be limiting, and is provided to illustrate the components of the lacrosse head, but is not meant to imply any design or specific features of the lacrosse head, other than those described herein. The compositions described herein can be utilized in any design or configuration of a lacrosse head.

As described herein, the lacrosse heads suitably comprise a blend of one or more polymers, in combination with graphene.

Examples of suitable polymeric materials that can be used in the lacrosse heads include polypropylene (PP), polyethylene (PE), amorphous polar plastics (e.g., polycarbonate (PC)), polymethylmethacrylate (PMMA), polystyrene (PS), high impact polystyrene (HIPS), polyphenylene oxide (PPO), glycol modified polyethylene terphthalate (PETG), acrylonitrile butadiene styrene (ABS), semicrystalline polar plastics (e.g., polyester PET and PBT), polyamide (nylon) (e.g., Nylon 6 and Nylon 6-6 (also called Nylon 6/6, Nylon 66 or Nylon 6,6), amorphous nylon, urethane, polyketone, polybutylene terephalate, acetals (e.g., DELRIN™ by DuPont), acrylic, acrylic-styrene-acrylonitrile (ASA), metallocene ethylene-propylene-diene terpolymer (EPDM) (e.g., NORDEL™ by DuPont), and composites thereof. In addition, fillers such as fiberglass, carbon fiber, mineral fill and the like can be added (for example 5-40% by weight) to create a custom polymeric composition.

As used herein "graphene" refers to an allotrope of carbon consisting of a single layer of carbon atoms arranged in a hexagonal lattice. Exemplary graphenes for use in the lacrosse heads described herein can have the following characteristics:

TABLE 1

GRAPHENE POWDER DETAILS

| Product | Average Lateral Dimension μm | Thickness nm | Oxygen Content % | Specific Surface Area m*/g | Tap Density g/cm* |
|---|---|---|---|---|---|
| A | 4 | 1-2 | <2.5 | 400-800 | 0.005-0.01 |
| B | 4 | 1-2 | <2.5 | 400-800 | 0.01-0.02 |
| C | 4 | 1-2 | 10-20 | 400-800 | 0.005-0.01 |
| D | 4 | 1-2 | 10-30 | 400-800 | 0.01-0.02 |
| E | 7 | 30-50 | <3 | 20-30 | 0.1-0.2 |
| F | 7 | 70-100 | <1 | 10-15 | 0.1-0.3 |
| G | 7 | 30-50 | <1 | 20-30 | 0.05-0.15 |
| H | 10 | 50-100 | <1 | 10-30 | 0.05-0.15 |

GRAPHENE POWDER CHEMISTRY

| Product | Carbon wt % | Hydrogen wt % | Nitrogen wt % | Oxygen wt % | Ash wt % |
|---|---|---|---|---|---|
| A | ≥95.00 | ≤2.00 | ≤0.05 | ≤2.05 | ≤2.50 |
| B | ≥95.00 | ≤2.00 | ≤0.05 | ≤2.00 | ≤2.50 |
| C | 60-80 | ≤2.00 | ≤0.05 | 10-30 | ≤2.50 |
| D | 70-90 | ≤2.00 | ≤0.05 | 10-30 | ≤2.50 |
| E | ≥95.00 | ≤1.00 | ≤0.20 | ≤4.00 | ≤2.50 |
| F | ≥97.00 | ≤1.00 | ≤0.50 | ≤2.00 | ≤1.00 |
| G | ≥96.00 | ≤1.00 | ≤0.20 | ≤1.00 | ≤2.50 |
| H | ≥97.00 | ≤1.00 | ≤0.20 | ≤1.00 | ≤2.50 |

In suitable embodiments, graphene denoted as "PD" here can be utilized (see letter C above in Table 1). PD graphene is a low oxygen content few layer graphene with a high surface area. Particle size distribution is as follows: MT50: 6.00 μm-8.00 μm. Average lateral dimension≤10.00 mm; average through-plane dimension 1.0-1.2 nm.

TABLE 2

PD Graphene

| | |
|---|---|
| Average lateral dimension | 4 μm |
| Thickness | 0.35-2 nm |
| Oxygen content | 10%-30% |
| Specific Surface area | 400-800 $m^2/g$ |
| Tap density | 0.005-0.01 $g/cm^3$ |
| Average aspect ratio | 3000:1 |
| Carbon by wt % | 60%-80% |
| Hydrogen by wt % | ≤2.00% |
| Nitrogen by wt % | ≤0.50% |
| Oxygen by wt % | 10%-30% |
| Ash by wt % | ≤2.50% |

In still further embodiments, graphene having a "GT" designation can be used in the lacrosse heads described herein. GT graphene is a few layer/multi-layer graphene that has been mechanically processed with one or more of the polymers described herein. The process for production of GT graphene, as well as the characteristics thereof, is set forth in U.S. 2017/0158513, the disclosure of which is incorporated by reference herein in its entirety.

In exemplary embodiments, the lacrosse head includes one or more polymers and about 0.05% to about 7% graphene. As used herein, when referring to the amount of graphene in the lacrosse head, the percentage amount (%) refers to a weight percent of graphene, measured against the total weight amount of composition of the lacrosse head (i.e., percent graphene=wt. graphene/total wt. of lacrosse head composition*100%). More suitably, the lacrosse heads described herein include about 0.1% to about 5%, or about 0.1% to about 3%, about 0.1% to about 1%, about 0.1% to about 0.5%, about 0.1% to about 0.4%, about 0.1% to about 0.3%, or about 0.1%, about 0.2%, about 0.3%, about 0.4%, about 0.5%, about 0.6%, about 0.7%, about 0.8%, about 0.9% or about 1.0%, graphene.

Graphene is suitably added to a molten polymeric composition including the desired polymer(s) and mixed until a homogenous dispersion is reached. The amount of graphene added is determined as described herein on a wt/wt basis of the polymeric composition. The polymeric composition including the graphene can then be formed into a lacrosse head using various procedures including molding, extrusion, etc., as known in the art.

In embodiments, the lacrosse head has a tensile strength of the throat that is at least about 3% greater than a lacrosse head comprising the polymer without the graphene.

Figure 2A:
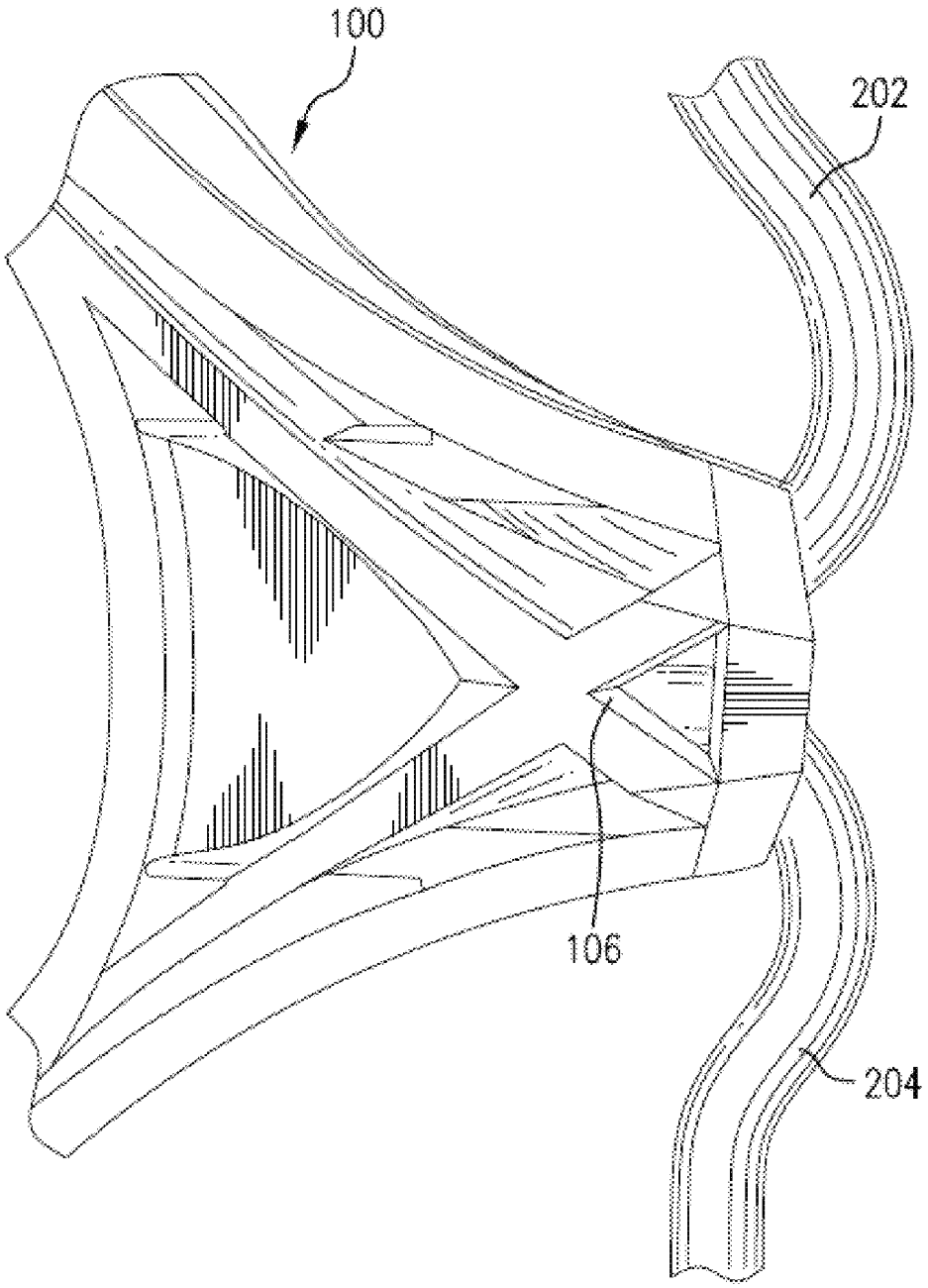
FIGS. 2A-2C show the experimental set-up and device used to measure tensile strength of the throat of a lacrosse head, in accordance with embodiments hereof.

As used herein "tensile strength of the throat" refers to the maximum force at failure that throat 106 of the lacrosse head can withstand while being placed under tension at either side of the open end of the throat. FIG. 2A shows an exemplary method for measuring tensile strength of the throat. As shown, two hooks (202 and 204) or similar anchors are placed inside of throat 106 of lacrosse head 100. The tensile strength of the throat is then measured by applying increasing tension separating the two hooks, until a break (a crack or fissure in at least some portion of the structure of the throat) is detected by the instrumentation (peak force drops dramatically and almost instantaneously once a break occurs). This breaking force provides the tensile strength of the throat.

As described herein, it has been determined that by adding graphene to the polymeric material that makes up the lacrosse head, the tensile strength of the throat of the composite lacrosse head (i.e., the lacrosse head that comprises the polymer with graphene) is at least about 1% greater than a lacrosse head prepared with only the polymer, but without the graphene, and then tested in an identical manner. In embodiments, the tensile strength of the throat is suitably at least about 1.5% greater than a lacrosse head comprising the polymer without the graphene, more suitably at least about 2% greater, at least about 2.5% greater, at least about 3% greater, at least about 3.5% greater, at least about 4% greater, at least about 4.5% greater, at least about 5% greater, at least about 5.5% greater, at least about 6% greater, at least about 6.5% greater, at least about 7% greater, at least about 7.5% greater, at least about 8% greater, at least about 8.5% greater, at least about 9% greater, at least about 9.5% greater, at least about 10% greater, or about 3%-10% greater, about 4%-9% greater, about 5%-9% greater, about 5%-8% greater, about 5%-7% greater, about 3% greater, about 4% greater, about 5% greater, about 6% greater, about 7% greater or about 8% greater, than a lacrosse head comprising the polymer without the graphene.

In exemplary embodiments, the polymer component of the lacrosse head is nylon, and in specific embodiments is nylon 6-6 (also called nylon 6,6, or nylon 66), and suitably impact modified nylon 6-6. Nylon 6-6 is made of two monomers each containing 6 carbon atoms, hexamethylenediamine and adipic acid:

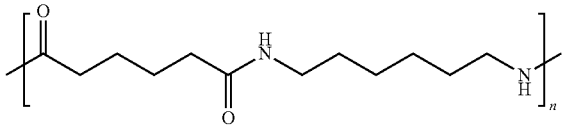

In suitable embodiments, the lacrosse head comprises nylon 6-6 and graphene present at about 0.1% to about 0.3%, including at about 0.1%, about 0.2% or about 0.3%, graphene.

In additional embodiments, the polymer component of the lacrosse head is polyketone, a high-performance thermoplastic polymer, having the following general structure:

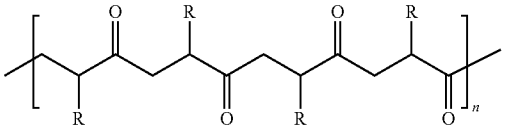

In further embodiments, provided herein (with reference to FIG. 1) is lacrosse head 100 comprising opposing sidewalls (102 and 104) joined at one end by throat 106, the sidewalls diverging generally outwardly, and the sidewalls being connected at another end by scoop 108. The lacrosse head suitably includes a blend of a nylon polymer and about 0.1% to about 1% graphene. Suitably, the lacrosse head can withstand more than 300 impacts prior to failure, wherein the lacrosse head has attained a kinetic energy of about 25 Joules to about 55 Joules, prior to each impact. In other embodiments, the lacrosse head suitably includes a blend of a polyketone polymer and about 0.1% to about 1% graphene. Suitably, the lacrosse head comprising polyketone can withstand more than 300 impacts prior to failure, wherein the lacrosse head has attained a kinetic energy of about 25 joules to about 55 Joules, prior to each impact.

As described in detail herein, an exemplary method has been developed to test the impact strength of a lacrosse head that includes a repeated rotation of a lacrosse head impacting a spring-loaded, steel impact arm having a weight of about 2-4 lbs. Prior to each impact, the lacrosse head attains a kinetic energy of about 25-55 Joules, depending on the weight of the lacrosse head and variability in the speed of the impacts. That is, prior to each time the lacrosse head impacts the impact arm, the lacrosse head has attained a kinetic energy of about 25-55 Joules, and then impacts that impact art, before again attaining the same kinetic energy range prior to another impact. See below and FIG. 3A regarding the exemplary testing method.

As described herein, this impact test is designed to provide a repeatable measure of the impact strength of a lacrosse head, so that different head designs and lacrosse head compositions can be compared. The number of impacts between the lacrosse head and the steel impact arm are counted. In embodiments, the lacrosse heads described herein can withstand more than 300 impacts (that is 300 contacts between the lacrosse head and the steel impact arm), prior to failure. As used herein "failure" refers to a visual crack or break 320 in the lacrosse head, rather than an elongation or plastic deformation 322 in the lacrosse head (see FIG. 3B).

A person of ordinary skill in the art will be able to calculate a kinetic energy that the lacrosse head attains prior to an impact, using standard physics principles. As described herein, the method used to determine the impact strength utilizes a rotating arm to impact the head against a steel impact arm, and thus rotational kinetic energy calculations are used to determine the kinetic energy the lacrosse head attains prior to each impact, of about 25-55 Joules.

In exemplary embodiments, the lacrosse heads described herein can withstand more than 100 impacts, more than 200 impacts, more than 300 impacts, more than 400 impacts, more than 500 impacts, more than 600 impacts, more than 700 impacts, more than 800 impacts, more than 900 impacts, more than 1,000 impacts, more than 1,100 impacts, more than 1,200 impacts, more than 1,300 impacts, more than 1,400 impacts, or more than 1,500 impacts prior to failure, wherein the lacrosse head has attained a kinetic energy of about 25 Joules to about 55 Joules, prior to each impact.

As described throughout, in exemplary embodiments the polymeric material used to create the lacrosse head comprises nylon 6-6, and suitably contains about 0.1% to about 0.3% graphene.

In further embodiments, the lacrosse head comprises polyketone, and suitably contains about 0.1% to about 0.3% graphene.

In additional embodiments, provided herein is a lacrosse head 100 (see FIG. 1) comprising opposing sidewalls (102 and 104) joined at one end by throat 106, the sidewalls diverging generally outwardly, and the sidewalls being connected at another end by scoop 108, and comprising a blend of an amorphous nylon polymer and about 0.1% to about 5% graphene. As described herein, the use of amorphous nylon allows the lacrosse heads to maintain a compression stiffness within about 30% over a temperature range of −15° C. to 52° C. When combined with graphene, the lacrosse heads suitably are able to withstand more than 100 impacts prior to failure, wherein the lacrosse heads have attained a kinetic energy of about 25 Joules to about 55 Joules, prior to each impact.

As used herein, "amorphous nylon" refers to a polyamide polymer (i.e., nylon) that does not exhibit any crystalline structures in X-ray or electron scattering experiments. In additional embodiments, an amorphous nylon can be a blend of different nylons that exhibit the lack of crystalline structures. In still further embodiments, nylon blends can be prepared that exhibit semi-crystalline structures, i.e., a mixture of amorphous and crystalline sections in the polymer. In addition, impact modifiers, such as ionomers, ethylene copolymers and grafted polymers, can also be added to amorphous nylon compositions.

In exemplary embodiments, the amorphous nylon lacrosse head can include graphene present at about 0.1% to about 3%, or about 0.1% to about 1% or about 0.1% to about 0.3%. Suitably, the addition of graphene at these amounts, including about 0.1% to about 5% (including about 0.1% to 3% or about 0.1% to 1%, about 0.1% to 0.5%, about 0.1% to 0.4%, about 0.1% to 0.3%, or about 0.1%, about 0.2%, about 0.3%, about 0.4%, about 0.5%) allows the lacrosse heads to withstand more than 100 impacts (suitably more than 150 impacts, more than 200 impacts, more than 250 impacts, or more than 300 impacts) prior to failure, wherein the lacrosse head has attained a kinetic energy of about 25 Joules to about 55 Joules, prior to each impact, while still maintaining a compression stiffness within about 30% over a temperature range of −15° C. to 52° C. In additional embodiments, the amorphous nylon lacrosse heads that include 0.1%-0.5% graphene, suitably about 0.1% graphene, maintain a compression stiffness within about 25% over a temperature range of 0° C. to 52° C., or a compression stiffness within about 15% over a temperature range of 0° C. to 40° C., while still allowing the heads to withstand more than 100 impacts prior to failure.

Figure 4A:
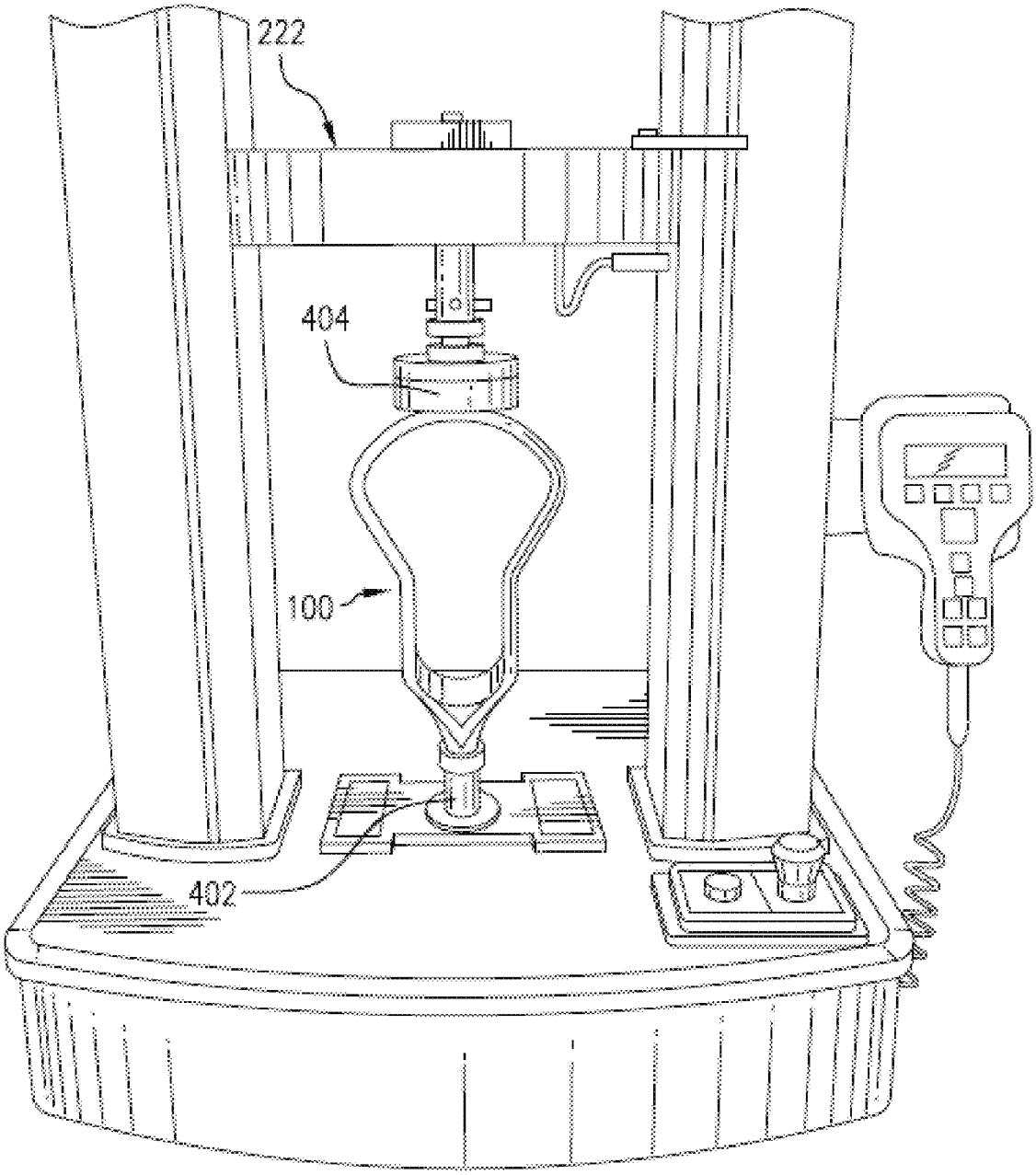
FIG. 4A shows the experimental set-up and device used to measure compression stiffness of a lacrosse head in accordance with embodiments hereof.

As described herein, "compression stiffness" refers to the force required to deflect a lacrosse head a distance of 0.25 inches, when the lacrosse head is pressed in a compressive manner when oriented vertically (compression is provided normal to scoop 108). See below and FIG. 4A regarding an exemplary compression stiffness measurement. The force to cause the 0.25 inch deflection varies only about 30% over a temperature range of −15° C. to 52° C., in exemplary lacrosse heads provided herein that contain amorphous nylon. The variation in the force to cause the 0.25 inch deflection, and thus the compression stiffness, over the temperature range is measured and compared, suitably resulting in a difference of only about 30% in the required force over the temperature range.

As described herein, a lacrosse head that maintains a relatively uniform stiffness (i.e., with a variation in compression stiffness of less that about 30%), provides predictable playability and reaction, regardless of temperature. As described herein, the addition of graphene suitably also provides for increased durability by providing added strength. This combination of relatively stable compression stiffness over a broad temperature range, in concert with increased durability, can provide a unique advantage to lacrosse players of all levels, including high level, competitive lacrosse.

In still further embodiments, provided herein is a lacrosse head 100 (see FIG. 1) comprising opposing sidewalls (102 and 104) joined at one end by throat 106, the sidewalls diverging generally outwardly, and the sidewalls being connected at another end by scoop 108, wherein the lacrosse head suitably comprises a blend of a nylon polymer and about 0.1% to about 1% graphene, and wherein the lacrosse head can withstand more than 300 impacts of an impact test prior to failure.

Figure 3A:
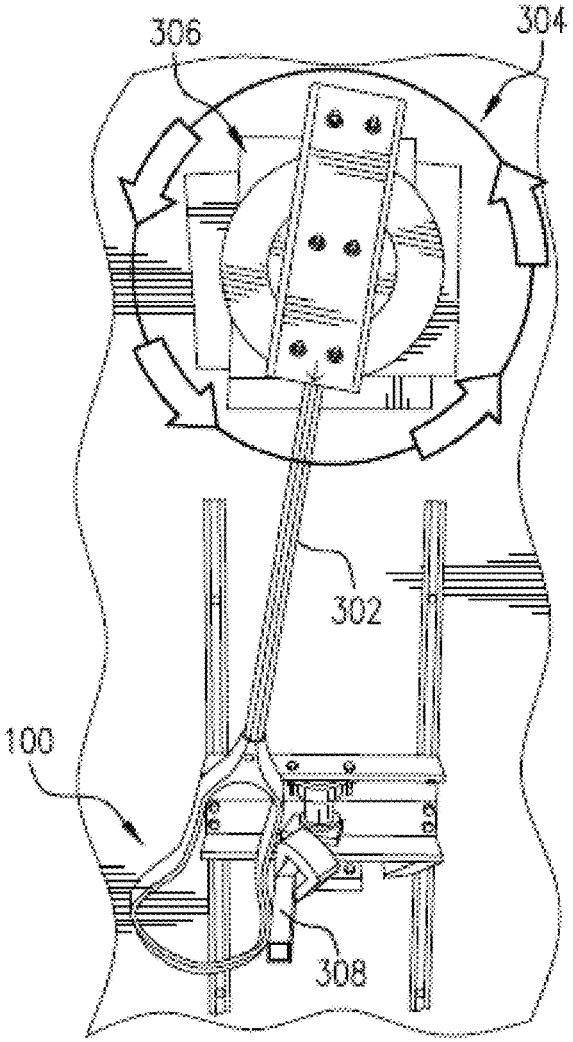
FIG. 3A shows the experimental set-up and device used in an impact test in accordance with embodiments hereof.
Figure 3B:
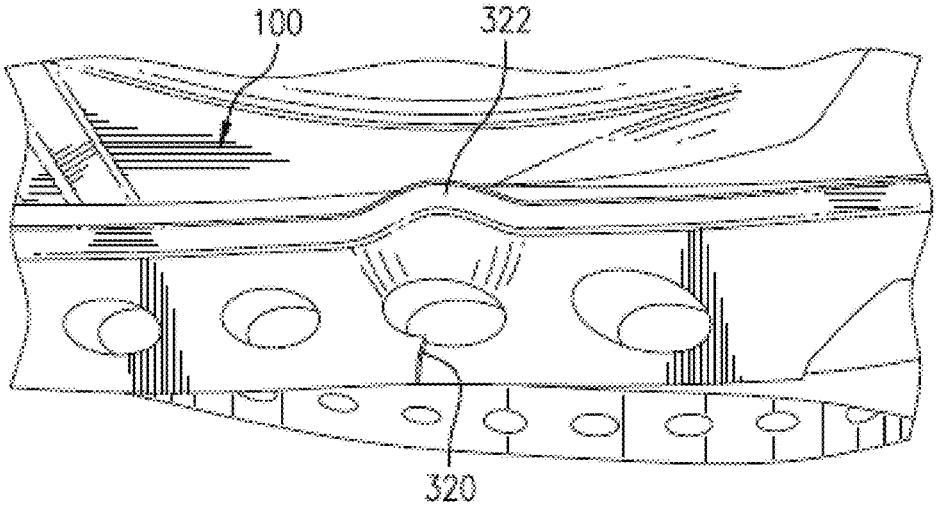
FIG. 3B shows a lacrosse head following an impact test.

In embodiments of this impact test as described herein with reference to FIG. 3A, lacrosse head 100 is attached to a shaft 302, the impact arm having a length of about 25-35 inches, suitably about 30 inches (center of point of rotation to impact bar). Shaft 302 is configured to rotate in a circular path 304, suitably via a rotating motor 306, or similar device.

Lacrosse head 100 is rotated in the circular path, suitably at a rate of about 20-25 m/s (at impact), and once during each rotation, lacrosse head 100 impacts a spring-loaded, steel impact arm 308. Suitably, spring-loaded, steel impact arm has a weight of about 2-4 lbs. Prior to each impact against spring-loaded, steel impact arm 308, lacrosse head 100 attains a kinetic energy of about 25 Joules to about 55 Joules. Following the impact, spring-loaded, steel impact arm 308, deflects out of the way, allowing lacrosse head 100 to continue on its circular path and repeat the impact test. The lacrosse head attains the same range of kinetic energy (about 25 to about 55 Joules) prior to each impact.

Suitably, the impact test is repeated at cycles of 10 impacts/cycle, before the test is started again. This also allows for repeatable and simple counting of the number of impacts until the lacrosse head fails, and to inspect the lacrosse head to determine if a failure has occurred.

As described throughout, in embodiments, the lacrosse head that is subjected to this impact test comprises a nylon polymer such as nylon 6-6. Suitably, the lacrosse head includes graphene present at about 0.1% to about 0.3%. In other embodiments, the lacrosse head can comprise polyketone, or an amorphous nylon, and graphene present at about 0.1% to about 0.3%.

In suitable embodiments, the lacrosse head can withstand more than 500 impacts prior to failure, the lacrosse head attaining a kinetic energy of about 25 Joules to about 55 Joules, prior to each impact. In additional embodiments, the lacrosse head can withstand more than 700 impacts prior to failure, the lacrosse head attaining a kinetic energy of about 25 Joules to about 55 Joules, prior to each impact, and in still further embodiments, the lacrosse head can withstand more than 1,000 impacts prior to failure, the lacrosse head attaining a kinetic energy of about 25 Joules to about 55 Joules, prior to each impact.

In additional embodiments, lacrosse shafts can also be prepared utilizing graphene to increase durability and impact strength. In exemplary embodiments, the lacrosse shafts can include one or more polymers as described herein and about 0.05% to about 7% graphene. More suitably, the lacrosse shafts described herein include about 0.1% to about 5%, or about 0.1% to about 3%, about 0.1% to about 1%, about 0.1% to about 0.5%, about 0.1% to about 0.4%, about 0.1% to about 0.3%, or about 0.1%, about 0.2%, about 0.3%, about 0.4%, about 0.5%, about 0.6%, about 0.7%, about 0.8%, about 0.9% or about 1.0%, graphene.

In still further embodiments, the compositions described herein which include a polymeric material in combination with graphene can also be used in other elements of sporting equipment that are subject to impact, to increase durability. Suitably, polymers such as polyamide (nylon) polymers, including nylon 6-6 and amorphous nylon can be used, along with other polymers including polypropylene (PP), polyethylene (PE), amorphous polar plastics (e.g., polycarbonate (PC)), polymethylmethacrylate (PMMA), polystyrene (PS), high impact polystyrene (HIPS), polyphenylene oxide (PPO), glycol modified polyethylene terphthalate (PETG), acrylonitrile butadiene styrene (ABS), semicrystalline polar plastics (e.g., polyester PET and PBT), urethane, polyketone, polybutylene terephalate, acetals (e.g., DELRIN™ by DuPont), acrylic, acrylic-styrene-acrylonitrile (ASA), metallocene ethylene-propylene-diene terpolymer (EPDM) (e.g., NORDEL™ by DuPont), and composites thereof, as well as inclusion of fillers such as fiberglass, carbon fiber, mineral fill and the like (for example 5-40% by weight) to create a custom polymeric composition. Amounts of graphene included in the compositions suitably will be about 0.1% to about 5%. Exemplary types of sporting equipment can include, for example, football helmets, biking helmets, hockey blades and sticks, hockey helmets, pads for lacrosse, football, hockey, etc., shin guards or other protective guards, field hockey sticks, baseball and softball bats, tennis rackets, badminton rackets, racquetball rackets, golf clubs (including heads and shafts), skis, ski boots (including bindings), etc.

Durability testing of such sporting equipment will demonstrate an increased ability to withstand impacts, as well as a compression stiffness that is relatively stable (i.e., within about 30%), over a temperature range that includes −15° C. to 52° C.

EXAMPLES

Example 1: Throat Tensile Strength

The following example describes the methods used to measure the tensile strength of the throat of a lacrosse head.

Equipment

Figure 2B:
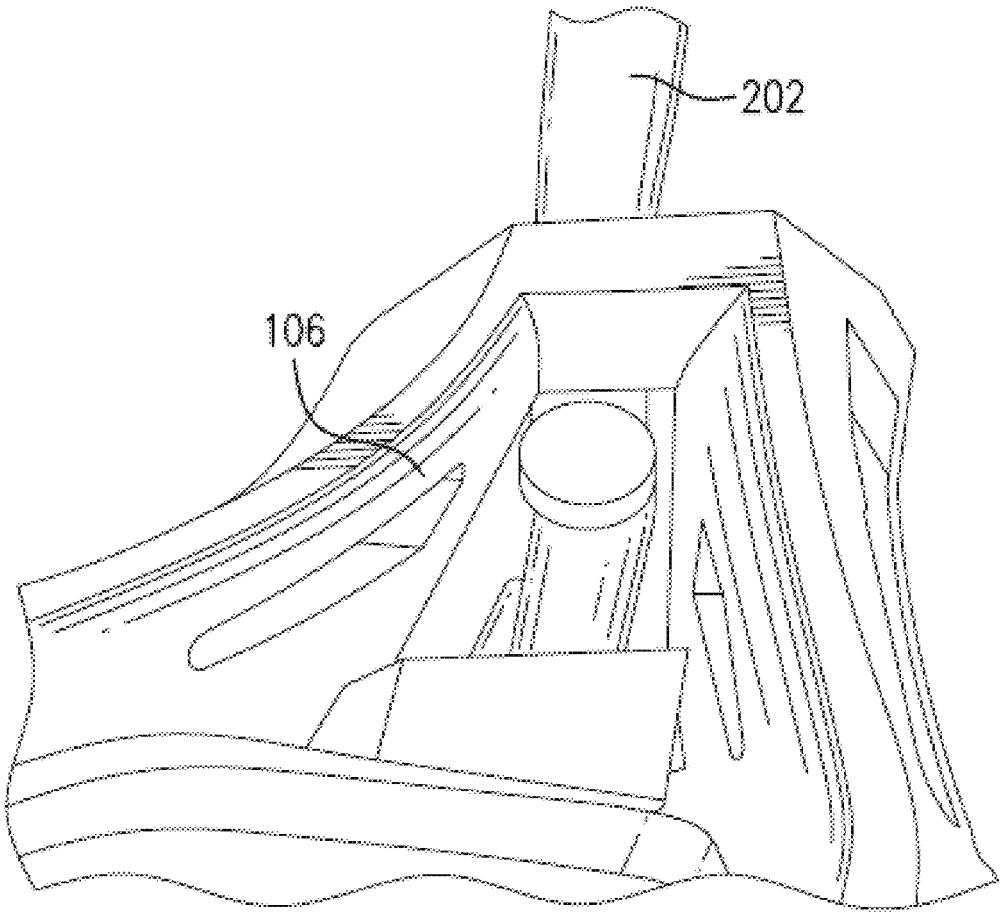
Figure 2C:
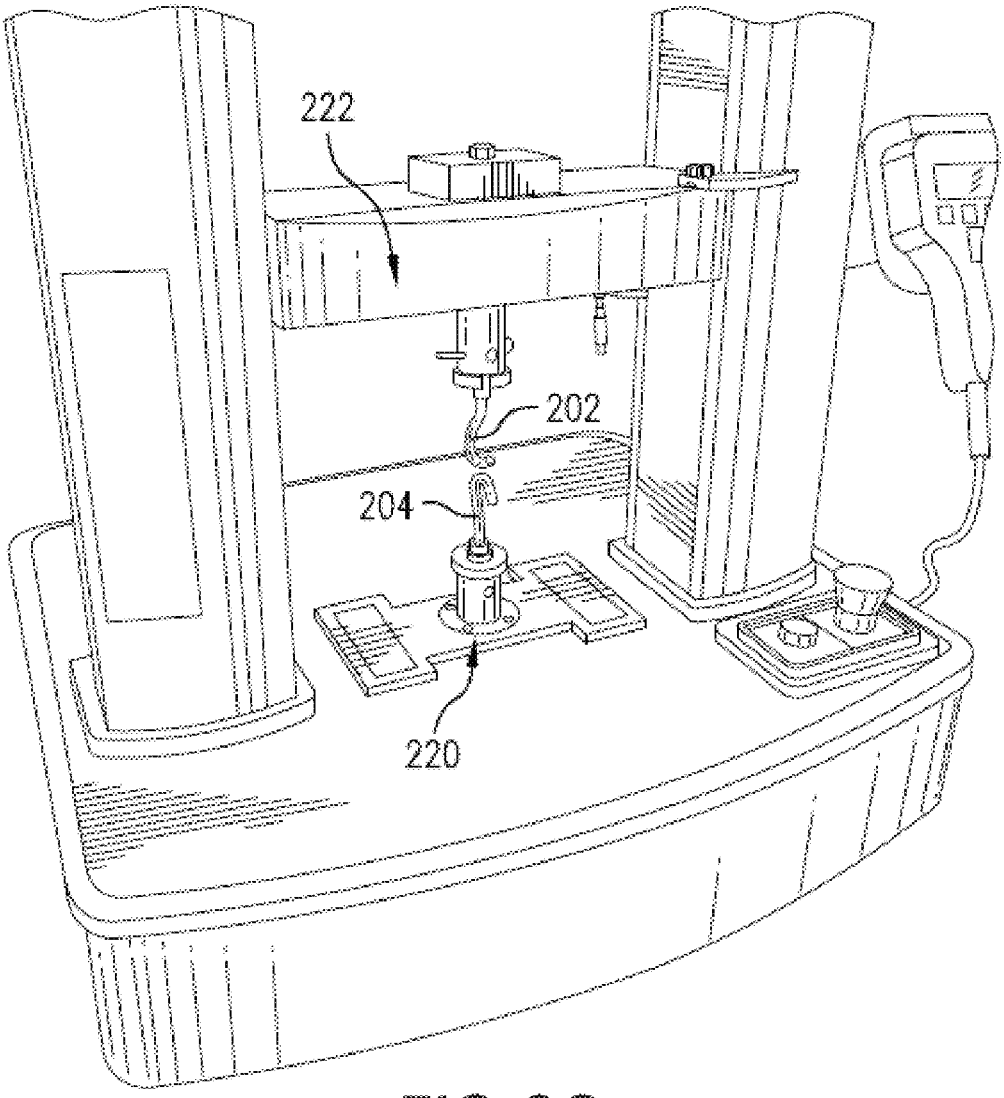

MTS Exceed Model E43 (see FIG. 2C)

Hook Attachments (202/204)

Environment

Temperature: 22° C.

Humidity: 50% (+/−10%)

Procedure

Attach hooks (202/204) to the MTS base (220) and crosshead (222).

Select the "Lacrosse Head Throat Tensile Test" template.

Lower crosshead 222 so that a 0.25" gap separates the two hook (202/204) attachments.

Place lacrosse head 100 on hooks, with hooks inserted into throat 106. See FIGS. 2A and 2B.

Pre-load to 0.5 lbf.

Start test.

After the throat has a complete break (determined by drop in peak force using instrumentation), record both the ultimate tensile strength (lbf) and modulus (psi).

Results

After the data is recorded and analyzed, the information is used to better understand the physical properties of different types of materials. This data is also cross-analyzed with other test results in order to determine if there is any correlation between a lacrosse head's "real life" characteristics (durability and flexibility) and the lab data (tensile strength).

Table 3 below shows the results of the tensile strength of the throat of exemplary lacrosse heads described herein. A Rebel-O lacrosse head design was selected for testing. Additional heads used in the testing described herein include Mirage and Rebel-D.

The Mirage lacrosse head is designed for attackmen. It has a light design and small rail cross-section. Maximum rail width of upper rail is 0.3" where side rail starts i.e. at ballstop (near throat). Bottom rail is 0.44" wide to still give it stiffness.

The Rebel-O lacrosse head is designed for a midfield player, heavier than the Mirage and wider side rails. Max rail width of upper and bottom rail is 0.4" where side rail starts. Rail width tapers smaller from ballstop to scoop. This head is used for offense and defense so must be combination of performance, light and strong.

The Rebel-D lacrosse head is designed for defensemen. Designed to be heavy, stiff, and has a wide side rail. Max rail width of upper and bottom rail is 0.5" where side rail starts. Rail width tapers smaller from ballstop to scoop. Because of wider rail, it is the stiffest head and so durability is important because stiffer often translates to poor impact performance. Side rails of any lacrosse head, by rule, cannot exceed 2" in height. The height of the bottom or top rail can vary.

TABLE 3

Results of Tensile Strength of Throat

| Resin Type | % Graphene | Throat Tensile Strength (lbf) | Percent Increase in Tensile Strength |
|---|---|---|---|
| Nylon 6-6 | 0 | 689.8 | 0% |
| Nylon 6-6 | 0.1 (PD) | 733.8 | 6.4% |
| Nylon 6-6 | 0.1 (GT) | 731.6 | 6.1% |

As noted above, the inclusion of 0.1% graphene increases the tensile strength of the throat of the lacrosse head by more than 6%.

Example 2: Compression Stiffness

The following example describes the methods used to measure the compression stiffness of a lacrosse head.

Compression stiffness determinations are used in order to understand how flexible a lacrosse head is at a variety of temperatures. The stiffness of a lacrosse head is one of the first things lacrosse players check. Many players want a stiff head while others prefer a more flexible head.

Equipment

Figure 4B:
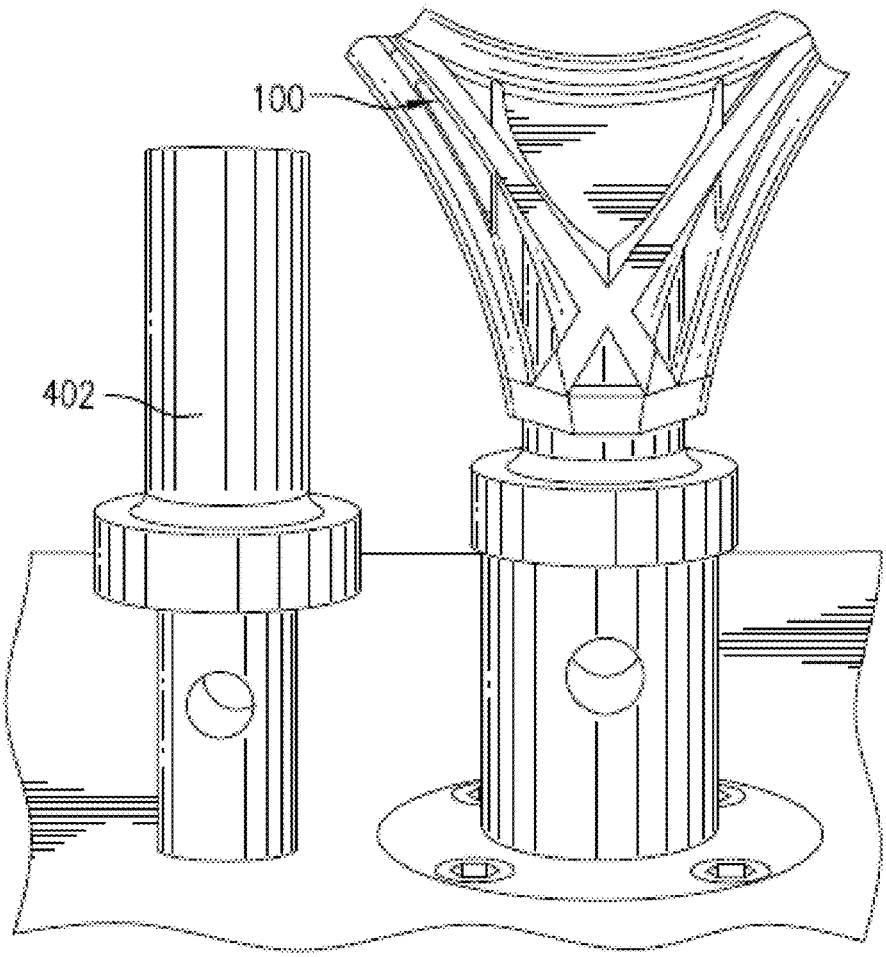
FIGS. 4B-4C show components used in the compression stiffness measurements described herein.
Figure 4C:
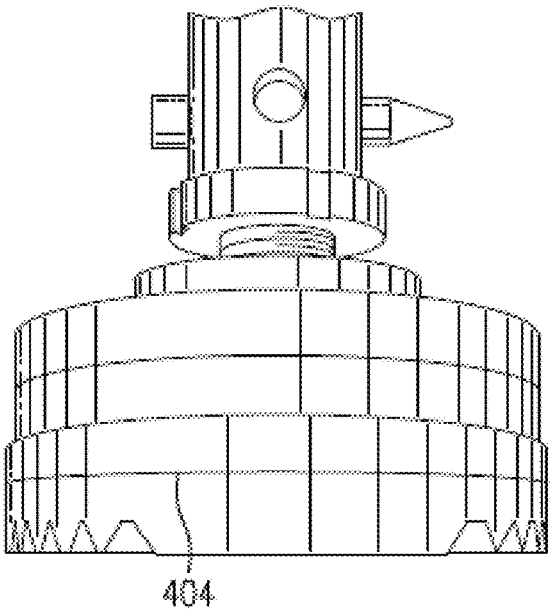

- MTS Exceed Model E43 (see FIG. 4A)
- Custom 3D Printed Attachments
  - Lacrosse Head Coupling (402) (see FIG. 4B)
  - Grooved Pressure Plate Attachment (404) (see FIG. 4C)
- Infrared Laser Thermometer
- Amorphous nylon compositions from RTP Co. (Winona, Minnesota)

Environment

- Temperature: 22° C.
- Humidity: 50% (+/−10%)

Procedure

- Turn MTS on and start software.
- Place lacrosse head 100 on MTS using custom coupling 402.
- Select the "Head Flexibility Test" in the software.
- Lower crosshead 222 on MTS until a pre-load of 0.5 lbf on lacrosse head 100 is reached.
- Start test, with increasing force (pounds force, lbf; perpendicular to lacrosse head 100) until a 0.25" deflection in the lacrosse head is reached.
- Continue testing head and record stiffness at each temperature.
- For the high temperature tests, place lacrosse head 100 in an enclosed environment over 52° C. for 10 minutes.
- Take head out of hot environment and position on MTS.
- Using an infrared thermometer, wait until scoop 108 of the lacrosse head cools down to 52° C. and begin test after pre-load is set.
- Record results.
- Continue to wait until the head temperature drops to 40° C. Pre-load and begin test once the scoop of the head reaches the target temperature.
- Record results.
- For the cold temperature tests, place lacrosse head in freezer that is −20° C. or colder for 10 minutes.
- Take lacrosse head out of the freezer and position on MTS.
- Using an infrared thermometer, wait until the temperature of scoop 108 warms to −15° C. (almost immediate). Begin test after pre-load is set.
- Record results.
- Continue to wait until the scoop of the head warms to 0° C.
- Once target temperature is reached, pre-load and begin the test.
- Record results.

Results

The data collected can be used to understand the effects of different environments on lacrosse heads and also to create competitive matrices.

Table 4 shows the results of compression stiffness testing on a lacrosse head comprising amorphous nylon and graphene. A REBEL-O™ lacrosse head design was selected for Tests 1-6, a DNA lacrosse head design was selected for Test 7. The DNA lacrosse head is designed for a midfield player, similar to the REBEL-O™, but with a flowing geometry void of sharp angles and throat windows which are included in the REBEL-O™. The DNA is heavier than the Mirage with wider side rails. Max rail width of upper and bottom rail is 0.4" where side rail starts. Rail width tapers smaller from ballstop to scoop. The DNA is designed with a flowing and smooth geometry with no windows in the throat region in order to reduce stress risers. This head is used for offense and defense so must be combination of performance, while also being light and strong.

TABLE 4

Results of Compression Stiffness Testing

| | | % | Compression Stiffness (lbf) at Temperature (Variability % Compared to 52° C.) | | | | |
|---|---|---|---|---|---|---|---|
| Test | Resin Type | Graphene | 52° C. | 40° C. | 22° C. | 0° C. | −15° C. |
| 1 | Amorphous Nylon | 0 | 30.5 (0%) | 31.5 (3.2%) | 33.5 (9.8%) | 33.9 (11.1%) | 34.1 (11.8%) |
| 2 | Amorphous Nylon | 0 | 31.3 (0%) | 33.1 (5.8%) | 33.7 (7.7%) | 34.2 (9.3%) | 35.8 (14.4%) |
| 3 | Amorphous Nylon | 0.1 (GT) | 29.8 (0%) | 30.7 (3.0%) | 33.2 (11.4%) | 34.9 (17.1%) | 36.4 (22.1%) |
| 4 | Amorphous Nylon | 0.1 (GT) | 28.7 (0%) | 32.1 (11.8%) | 32.7 (13.9%) | 35.5 (23.7%) | 36.7 (28.9%) |
| 5 | Amorphous Nylon | 0.1 (PD) | 30.2 (0%) | 32.8 (8.6%) | 33.7 (11.6%) | 35.4 (17.2%) | 36.4 (20.5%) |
| 6 | Amorphous Nylon | 0.1 (PD) | 29.5 (0%) | 31.4 (6.4%) | 33.2 (12.5%) | 35.1 (19.0%) | 35.8 (21.4%) |
| 7 | Amorphous Nylon | 0.1 (GT) | 36.4 (0%) | 38 (4.4%) | 41.1 (12.9%) | 42 (15.4%) | 42.2 (15.9%) |

As noted above, the lacrosse heads maintain a compression stiffness within about 30% over the temperature range 52° C. to −15° C. That is, the compression stiffness measured at 52° C. increases or decreased by only about 30% when compared to the lower temperatures. If the temperature range 40° C. to 0° C. is examined, the variability (comparing relative to the compression stiffness measured at 40° C.) is only about 15%.

Example 3: Impact Testing

The following example describes the methods used to measure the impact durability (or strength) of a lacrosse head. If a lacrosse head survives a predetermined amount of cycles (generally 300 cycles) it is considered ready for play. The test also provides competitive matrices from the data collected.

Equipment
- Thor XL (custom built—see FIG. 3A)

Environment
- Temperature: 22° C.
- Humidity: 50% (+/−10%)

Materials and Specs
- 3-Phase Induction Motor (306) (IronHorse model #MTCP-001-3BD12)
- Impact Arm (308) (McMaster-Carr Part #6527K364)
- Steel
- Weight—2.8 lbs. (including flange and fasteners)
- Height—1"
- Width—1"
- Length—1'
- Torsion Spring (308) (McMaster-Carr Part #9271K126)

TABLE 5

Torsion Spring Characteristics

| | | | |
|---|---|---|---|
| Spring Type | Torsion | Leg Length | 4" |
| Deflection Angle | 180° | Number of Colls | 9 |
| Wind Direction | Right Hand | Spring Length @ Maximum Torque | 1.533" |
| OD | 1.189" | Maximum Torque | 42.86 in.-lbs. |
| For Shaft Diameter | 0.735" | Material | Music-Wire Steel |
| Wire Diameter | 0.135° | RoHS | Complaint |

- AC Drive (GS2 Series Drive Model GS2-11P0)
- Frequency—50 hz (Velocity at impact is 50 mph±5 mph (22.4 m/s±2.2 m/s)
- Titanium Shaft (302) to hold lacrosse head
- 30" radius from center axis of motor (306) and impact arm (308).

Procedure
- Place a lacrosse head on shaft and screw into place.
- Turn on and release the E-stop.
- Press the "10 Cycle" button.
- Record the # of hits.
- Continue testing and observing until the lacrosse head fails (defined as a visual crack, fracture or break (320 in FIG. 3B), not a plastic deformation or elongation (322 in FIG. 3B)).
- Stop test after head reaches the desired number of minimum impacts (suitably 100-300).
- Record the number of impacts along with a pass/fail grade.
- ** Additional testing can go beyond the minimum number of impacts in order to reach failure to understand the limits of different types of heads and materials.

Results
- Pass Criteria: Head survives 100 impacts (or higher, e.g., 300 impacts) without breaking.
- Fail Criteria: Head breaks before 100 impacts (or higher, e.g., 300 impacts). Heads are also taken beyond 300 impacts to determine the ultimate number of impacts that can be withstood prior to failure.
- Table 6 shows the calculation of the kinetic energy of the lacrosse head prior to impact between the lacrosse head and the spring-loaded, steel impact beam. A range of linear velocities was used to provide general ranges for the kinetic energy. In addition, several different lacrosse head styles were included, with different masses, to provide a range for the kinetic energy of the lacrosse head during the impact testing. As indicated, the range of kinetic energies of the lacrosse head prior to each impact is from about 25 Joules to about 55 Joules.

TABLE 6

Kinetic Energy Calculation for Impact Testing

Test Instrument Characteristics

| | |
|---|---|
| Shaft (302 in FIG. 3A) Radius | 0.762 m |
| Linear Velocity (low) | 20.11677 m/s |
| Linear Velocity (mid) | 22.35196 m/s |
| Linear Velocity (high) | 24.58716 m/s |

Kinetic Energy Calculations

| Lacrosse Head Design | Material | Mass (kg) | Velocity (m/s) | Radius (m) | Angular Velocity (rad/s) (ω = Velocity/ Radius) | Mass Moment of Inertia (kg m$^2$) I = Mass* Radius$^2$ | Rotational Kinetic Energy (Joules) $KE_{rot}$ = ½* I * ω$^2$ |
|---|---|---|---|---|---|---|---|
| Rebel-O | Nylon 6-6 | 0.139 | 20.117 | 0.762 | 26.400 | 0.0807 | 28.126 |
| Rebel-O | Nylon 6-6 | 0.139 | 22.35196 | 0.762 | 29.333 | 0.0807 | 34.723 |
| Rebel-O | Nylon 6-6 | 0.139 | 24.58716 | 0.762 | 32.267 | 0.0807 | 42.015 |
| Rebel-O | Nylon 6-6 with 0.3% Graphene (GT) | 0.145 | 20.117 | 0.762 | 26.400 | 0.0842 | 29.340 |
| Rebel-O | Nylon 6-6 with 0.3% Graphene (GT) | 0.145 | 22.35196 | 0.762 | 29.333 | 0.0842 | 36.222 |
| Rebel-O | Nylon 6-6 with 0.3% Graphene (GT) | 0.145 | 24.58716 | 0.762 | 32.267 | 0.0842 | 43.828 |
| Rebel-O | Polyketone | 0.156 | 20.117 | 0.762 | 26.400 | 0.0906 | 31.565 |
| Rebel-O | Polyketone | 0.156 | 22.35196 | 0.762 | 29.333 | 0.0906 | 38.970 |
| Rebel-O | Polyketone | 0.156 | 24.58716 | 0.762 | 32.267 | 0.0906 | 47.153 |

TABLE 6-continued

| Kinetic Energy Calculation for Impact Testing | | | | | | | |
|---|---|---|---|---|---|---|---|
| Rebel-O | Polyketone with 0.1% Graphene (GT) | 0.159 | 20.117 | 0.762 | 26.400 | 0.0923 | 32.172 |
| Rebel-O | Polyketone with 0.1% Graphene (GT) | 0.159 | 22.35196 | 0.762 | 29.333 | 0.0923 | 39.719 |
| Rebel-O | Polyketone with 0.1% Graphene (GT) | 0.159 | 24.58716 | 0.762 | 32.267 | 0.0923 | 48.060 |
| Rebel-O | Amorphous Nylon | 0.156 | 20.117 | 0.762 | 26.400 | 0.0906 | 31.565 |
| Rebel-O | Amorphous Nylon | 0.156 | 22.35196 | 0.762 | 29.333 | 0.0906 | 38.970 |
| Rebel-O | Amorphous Nylon | 0.156 | 24.58716 | 0.762 | 32.267 | 0.0906 | 47.153 |
| Rebel-O | Amorphous Nylon with 0.1% Graphene (GT) | 0.153 | 20.117 | 0.762 | 26.400 | 0.0888 | 30.958 |
| Rebel-O | Amorphous Nylon with 0.1% Graphene (GT) | 0.153 | 22.35196 | 0.762 | 29.333 | 0.0888 | 38.220 |
| Rebel-O | Amorphous Nylon with 0.1% Graphene (GT) | 0.153 | 24.58716 | 0.762 | 32.267 | 0.0888 | 46.246 |
| Mirage | Nylon 6-6 | 0.131 | 20.117 | 0.762 | 26.400 | 0.0761 | 26.507 |
| Mirage | Nylon 6-6 | 0.131 | 22.35196 | 0.762 | 29.333 | 0.0761 | 32.724 |
| Mirage | Nylon 6-6 | 0.131 | 24.58716 | 0.762 | 32.267 | 0.0761 | 39.597 |
| Mirage | Polyketone | 0.147 | 20.117 | 0.762 | 26.400 | 0.0854 | 29.744 |
| Mirage | Polyketone | 0.147 | 22.35196 | 0.762 | 29.333 | 0.0854 | 36.721 |
| Mirage | Polyketone | 0.147 | 24.58716 | 0.762 | 32.267 | 0.0854 | 44.433 |
| Mirage | Polyketone with 0.3% Graphene (GT) | 0.147 | 20.117 | 0.762 | 26.400 | 0.0854 | 29.744 |
| Mirage | Polyketone with 0.3% Graphene (GT) | 0.147 | 22.35196 | 0.762 | 29.333 | 0.0854 | 36.721 |
| Mirage | Polyketone with 0.3% Graphene (GT) | 0.147 | 24.58716 | 0.762 | 32.267 | 0.0854 | 44.433 |
| Rebel-D | Nylon 6-6 | 0.174 | 20.117 | 0.762 | 26.400 | 0.1010 | 35.208 |
| Rebel-D | Nylon 6-6 | 0.174 | 22.35196 | 0.762 | 29.333 | 0.1010 | 43.466 |
| Rebel-D | Nylon 6-6 | 0.174 | 24.58716 | 0.762 | 32.267 | 0.1010 | 52.594 |
| Rebel-D | Nylon 6-6 with 0.3% Graphene (GT) | 0.174 | 20.117 | 0.762 | 26.400 | 0.1010 | 35.208 |
| Rebel-D | Nylon 6-6 with 0.3% Graphene (GT) | 0.174 | 22.35196 | 0.762 | 29.333 | 0.1010 | 43.466 |
| Rebel-D | Nylon 6-6 with 0.3% Graphene (GT) | 0.174 | 24.58716 | 0.762 | 32.267 | 0.1010 | 52.594 |

Table 7 shows the results of impact testing on various lacrosse heads having the specified designs, polymer compositions, and inclusion of graphene, as applicable.

TABLE 7

| Head Design | Polymer Composition | Percent Graphene | Number of Impacts Until Failure |
|---|---|---|---|
| Rebel-O | Nylon 6-6 | 0 | 370 |
| Rebel-O | Nylon 6-6 | 0 | 500 |
| Rebel-O | Nylon 6-6 | 0 | 510 |
| Rebel-O | Nylon 6-6 | 0.1 (PD) | 1000 (test stopped, but no failure) |
| Rebel-O | Nylon 6-6 | 0.1 (GT) | 1000 (test stopped, but no failure) |
| Rebel-O | Nylon 6-6 | 0.3 (GT) | 740 |
| Rebel-O | Nylon 6-6 | 0.3 (GT) | 1000 (test stopped, but no failure) |
| Rebel-O | Polyketone | 0 | 350 |
| Rebel-O | Polyketone | 0.1 (GT) | 1000 (test stopped, but no failure) |
| mRebel-O | Polyketone | 0.1 (GT) | 2000 (test stopped, but no failure) |
| Mirage | Nylon 6-6 | 0 | 190 |
| Mirage | Polyketone | 0 | 500 |
| Mirage | Polyketone | 0.1 (GT) | 670 |
| Rebel-D | Nylon 6-6 | 0 | 520 |
| Rebel-D | Nylon 6-6 | 0.3 | 1000 (test stopped, but no failure) |

As shown, inclusion of graphene in a nylon 6-6 polymeric lacrosse head increased the number of impacts that the lacrosse head can withstand from about 500 to above 700, including above 1000. A polyketone lacrosse head also showed an increase in durability, able to withstand greater than 500 or 600 impacts.

Table 8 shows prophetic predictions of impact testing on lacrosse heads having the specified designs, polymer compositions, and inclusion of graphene, as applicable. These predictions are prophetic and are estimated based on the disclosure provided herein.

TABLE 8

Prophetic Impact Testing

| Head Design | Polymer Composition | Percent Graphene | Number of Impacts Until Failure |
|---|---|---|---|
| Rebel-O | Amorphous Nylon | 0 | 50 |
| Rebel-O | Amorphous Nylon | 0.3 | >100 |
| Rebel-O | Amorphous Nylon | 0.5 | >100-200 |

Predicted in Table 8 is the ability of graphene to increase the durability of an amorphous nylon lacrosse head so as to be able to withstand greater than 100 hits, suitably greater than 150 or 200 hits. Table 9 shows the ability of graphene to increase the durability of an amorphous nylon lacrosse head (DNA) to withstand greater than 100 hits, including greater than 150 hits, or greater than 100 hits.

TABLE 9

Results of Impact Testing - Amorphous Nylon

| Head Design | Polymer Composition | Percent Graphene | Number of Impacts Until Failure |
|---|---|---|---|
| DNA | Amorphous Nylon | 0.1 | 230 |
| DNA | Amorphous Nylon | 0.1 | 130 |
| DNA | Amorphous Nylon | 0.1 | 170 |

Thus, the breadth and scope of the present invention should not be limited by any of the above-described exemplary embodiments, but should be defined only in accordance with the appended claims and their equivalents. It will also be understood that each feature of each embodiment discussed herein, and of each reference cited herein, can be used in combination with the features of any other embodiment. All patents and publications discussed herein are incorporated by reference herein in their entirety.

What is claimed is:

1. A lacrosse shaft comprising:

a polymeric composite comprising a polymer, a carbon fiber filler, and about 0.05% to about 7% graphene.

2. The lacrosse shaft of claim 1, wherein the grapheme is present at about 0.1% to about 5%.

3. The lacrosse shaft of claim 1, wherein the graphene is present at about 0.1% to about 3%.

4. The lacrosse shaft of claim 1, wherein the graphene is present at about 0.1% to about 1%.

5. The lacrosse shaft of claim 1, wherein the lacrosse shaft demonstrates an increased ability to withstand impacts, as well as a compression stiffness that is stable over a temperature range of −15° C. to 52° C.

6. The lacrosse shaft of claim 1 having a length of at least about 25-35 inches.

* * * * *